US005345140A

United States Patent [19]

Holten

[11] Patent Number: 5,345,140

[45] Date of Patent: Sep. 6, 1994

[54] ELECTRIC LAMP ARRANGEMENT WITH REFLECTOR

[75] Inventor: Petrus A. J. Holten, Nevers Cédex, France

[73] Assignee: U.S. Philips Corporation, New York, N.Y.

[21] Appl. No.: 926,580

[22] Filed: Aug. 6, 1992

[30] Foreign Application Priority Data

Aug. 9, 1991 [EP] European Pat. Off. ..... 91202043.5
Sep. 19, 1991 [EP] European Pat. Off. ..... 91202417.1

[51] Int. Cl.[5] ..... H01J 5/16; F21V 7/00

[52] U.S. Cl. ..... 313/113; 313/114; 313/634; 362/297; 362/298; 362/310; 362/346; 362/347

[58] Field of Search ..... 313/113, 114, 148, 634; 362/297, 298, 302, 310, 346, 347

[56] References Cited

U.S. PATENT DOCUMENTS 4,021,659 5/1977 Wiley ..... 313/113
4,788,469 11/1988 Holten ..... 313/114
4,803,394 2/1989 Holten ..... 362/302
5,084,648 1/1992 Holten ..... 313/114
5,099,168 3/1992 Holten ..... 313/114

FOREIGN PATENT DOCUMENTS 0284117 9/1990 European Pat. Off. .
410525A 1/1991 European Pat. Off. ..... 313/113
1264610 3/1968 Fed. Rep. of Germany ..... 313/113

*Primary Examiner*—Donald J. Yusko
*Assistant Examiner*—Matthew J. Esserman
*Attorney, Agent, or Firm*—Robert J. Kraus

[57] ABSTRACT

An electric lamp arrangement includes a reflector (10) having first and second mirror walls (12 and 22), which in axial sections are curved according to circular arcs (13, 23), the centers of which lie in an area between lines (15, 16) enclosing angles $\beta$ and $\gamma$ with a plane P defining the largest diameter (d), and in an ellipse-shaped area Q, respectively. The reflector has a relatively small, light-emitting window (30) of at most 0.7 d, disposed opposite a lamp base (1). An electric light source (3) is disposed within the reflector (10) near plane P and an axis (11). The reflector (10) may be integral with a lamp vessel (5) to give a reflector lamp or a pressed-glass lamp. Alternatively, the light source may have an envelope and may be secured within the reflector to constitute a lamp-reflector unit. The reflector effectively shapes radiation emitted by the light source into a wide beam of high intensity. Embodiments provide an equal illumination of a large area by means of several light sources arranged beside each other. Other embodiments provide a homogeneous illumination of a relatively large area.

14 Claims, 4 Drawing Sheets

ELECTRIC LAMP ARRANGEMENT WITH REFLECTOR

BACKGROUND OF THE INVENTION

The invention relates to an electric lamp arrangement comprising:

a lamp cap provided with contacts;

a rotationally symmetrical reflector provided with an axis of symmetry and a largest diameter d in a plane P transverse to the axis of symmetry;

a first internally concave, mirroring wall portion behind the plane P which, in axial cross-sections at a first side of the axis is curved substantially according to a circular arc having a center of curvature in front of the plane P, which first wall portion is situated adjacent the lamp cap;

a second internally concave, mirroring wall portion in front of the plane P which in axial cross-sections at the first side of the axis is substantially curved according to a circular arc having a center of curvature behind the plane P, at the other side of the axis;

a light-transmissive window which is intersected by the axis; and an electric light source being arranged in the reflector in the vicinity of the axis and of the plane P and connected to current conductors which extend to the contacts of the lamp cap.

The invention also relates to a blown bulb and to a reflector for use therein.

An electric incandescent lamp in which the reflector of the geometry described is integral with the lamp vessel of the incandescent lamp so as to form a reflector lamp is known from EP 0 284 117 B1.

A light source, an incandescent body, is arranged so as to surround the axis of the lamp vessel in this incandescent lamp. The mirroring wall portions form a light beam with a very high intensity in its center, along the axis. The beam has a small width of approximately 25°.

The small beam width of the known lamp is also apparent from the beam pattern depicted in FIGS. 2 to 5 of the cited Patent. It is clear from these Figures that the second mirroring wall portion must not extend to a greater distance away from the plane of largest diameter since this wall portion would then block out light coming from the first mirroring wall portion. As a result, the transmissive window is comparatively large and has a diameter which is more than 85% of the largest diameter; for lamps having a largest diameter of 60 mm, at least 86%; for lamps having a largest diameter of 95 mm, 89%.

The known lamp is suitable for brightly illuminating objects or areas of restricted dimensions; and thus for giving local light accents.

For other applications, however, it is desirable to have available a lamp which projects a comparatively wide beam and is thus capable of irradiating, for example lighting, a comparatively large field or large object. For alternative applications it is again necessary to irradiate a large field with a lamp emitting UV light, or IR light, for example, in stock breeding or for therapeutic purposes. It is true that for therapeutic applications the area to be irradiated is not extensive, but a small distance to the source of radiation is required for obtaining a high irradiation intensity, and therefore a comparatively wide beam.

It is noted that several types of reflector lamps, i.e. lamps having a mirroring coating on a portion of the lamp vessel, are available which give a wide light beam. The mirroring portion of the lamp vessel in these lamps is, for example, curved parabolically or elliptically, and the light-transmissive window is light-scattering, as is the surface of the portion on which the mirror is provided. The incandescent body in these lamps is outside the optical center. These lamps have their light-transmissive windows in the plane of largest diameter. They do not concentrate the generated light in a very effective manner and give much scattered light.

SUMMARY OF THE INVENTION

It is an object of the invention to provide an electric lamp arrangement of the kind described in the opening paragraph which effectively concentrates the generated radiation into a comparatively wide beam. In particular, it is an object to provide such an electric lamp arrangement which is capable of irradiating a comparatively large field evenly with a comparatively wide beam.

According to the invention, this object is achieved in that the first mirroring wall portion in every axial cross-section at the first side of the axis is curved substantially according to a circular arc having its center of curvature situated in a region which lies predominantly at the other side of the axis and which is bounded by lines which enclose an angle $\beta$ and an angle $\gamma$ of 23° and 39°, respectively, with the plane P and which intersect the plane P in the point where the first mirroring wall portion intersects the plane P at the first side of the axis;

the second mirroring wall portion has a center of curvature which is situated in a region having the shape of an ellipse Q whose major axis has a first end in the plane P at a distance of 0.02 d from the axis of symmetry and a second end at a distance of 0.07 d from the plane P and 0.13 d from the axis of symmetry, which ellipse has a major axis which is 6.8 times the length of the minor axis;

the light-transmissive window has a largest diameter smaller than 0.8 d.

The electric lamp arrangement according to the invention yields a wide beam of 50° or more, for example, 60° or 70° the generated radiation being very effectively concentrated into a beam. It is highly remarkable that the wide beam is created in spite of a comparatively narrow window. In contrast to the known lamp of the cited EP 0 284 117 B1, the window in the light source with reflector according to the invention is comparatively small, in general smaller than 75% of the largest diameter d, for example 0.6–0.75 d, more particularly, 0.6 to 0.7 d. This is accompanied by the fact that the mirroring wall portions surround the light source through a greater solid angle and project more radiation into the beam. The quality of the lamp is comparatively poor when the window is comparatively large.

An advantage in this case is that there is a wide freedom in positioning of the light source and in its shape. Thus the light source may be arranged axially or transversely, for example, linearly. An incandescent body as the light source may have, for example, a compact shape, such as M-shape, and be axially arranged or, for example, be mounted as a linear cylinder transverse to the axis or as an open polygon around the axis.

It was surprisingly found that the contours and the light distribution of the light beam formed show very little dependence on the shape and position of the light source. Instead of an incandescent body, an envelope, for example a tubular envelope, containing a halogen gas may be used as a light source. Alternatively, a pair of electrodes in an ionizable medium arranged in an envelope may be used as the light source. Examples include a high-pressure sodium discharge lamp or a high-pressure mercury discharge lamp, which may be used in horticulture or for general lighting.

The light source may be enclosed in a lamp vessel with which the reflector is integral so as to form a reflector lamp which is provided with a lamp cap. Wall portions of the lamp vessel are then shaped and mirrored in such a way that the reflector is formed. The lamp vessel may be made (e.g. it may be blown) from glass. The lamp vessel may alternatively have a seam in the plane P. It is then built up from a first and a second molded piece which comprise the first and the second wall portion, respectively. The second molded piece may also have a wall portion which forms the light-transmissive window. A neck-shaped portion may be present at a lamp vessel remote from the light-transmissive window, carrying the lamp cap. Alternatively, however, the lamp cap may be supported by the first molded piece itself.

The light source may alternatively be fastened in a reflector, for example a metal reflector, so as to form a lamp/reflector unit which supports a lamp cap. The light-transmissive window may or may not be closed off by, for example, a glass disc.

The reflector together with a lampholder may alternatively form a luminaire in which the light source can be accommodated with its lamp cap placed in the lampholder. The invention also relates to such a reflector. The reflector may be separable in the plane P to render the insertion of a light source therein easier.

It will be obvious that the same arrangement of optical elements and the same cooperation for the purpose of concentrating generated radiation into a comparatively wide beam are realized in these embodiments.

The invention also relates to a blown bulb suitable for being used integrally with the reflector in the electric lamp arrangement.

An optical glass disc may be provided in the window, for example in a lamp/reflector unit according to the invention. The disc need not have an optical purpose but, may be fully transparent and close off a lamp vessel or a reflector to prevent pollution of the reflector. Alternatively, the disc may be light scattering, for example, satin-frosted. Very even light beams are obtained also without a glass disc or with a transparent disc.

Various types of ray paths can be distinguished within the reflector. A first path is followed by rays which directly hit the first mirroring wall portion, coming from the light source. They are mainly thrown directly to the exterior through the light-transmissive window. These rays are mainly reflected at comparatively great angles to the axis.

A second path is followed by rays which travel from the light source to the second mirroring wall portion and are reflected to the first wall portion, upon which they issue at an angle to the axis which ranges from comparatively small to comparatively great. The uniformity of the formed beam is promoted by this. A third path is followed by rays issuing to the exterior directly from the light source. They run alongside the axis at angles to this axis which range from very small to comparatively great.

A favorable embodiment of the electric lamp arrangement according to the invention has a reflector in which the first mirroring wall portion has a center of curvature which is situated in a region having the shape of an ellipse R whose major axis has a first end at the first side of the axis of symmetry at a distance of 0.23 d from the plane P and 0.04 d from the axis of symmetry, and a second end at the other side of the axis of symmetry at a distance of 0.38 d from the plane P and 0.07 d from the axis of symmetry, which ellipse has a major axis which is 10.4 times the length of the minor axis.

Such a reflector lamp was compared with several commercially available reflector lamps of various origins. All lamps have a largest diameter of 95 mm. The results are given in Table 1.

Table 1 shows that the lamp according to the invention (L) concentrates the generated light into a beam in a much more efficient way than the known lamps.

This great difference in the efficiency of the beam concentration of the generated light can be utilized for realizing higher illuminance values, for realizing the same, low illuminance on a field of a given size by means of fewer lamps, or for achieving the same, low illuminance by means of the same number of lamps of a lower power rating. If the increased effectivity is used for saving energy, this saving will amount to approximately 40%. For the United States of America alone, this means a power saving of 400 MW for the fifty million reflector lamps having a largest diameter of 95 or 125 mm used every year. This is half the power of a power station.

TABLE 1

| Lamp | P (W) | b.w. (°) | $\bar{E}$ (lx) |
|---|---|---|---|
| A | 75 | 70 | 306 |
| B | 65 | 75 | 269 |
| C | 75 | 65 | 288 |
| D | 75 | 65 | 271 |
| L | 75 | 65 | 520 |

b.w. = beam width = angle between directions in which the luminous flux (I) is 50% of the luminous flux along the axis ($I_0$).
$\bar{E}$ = *average illuminance in a surface having a diameter of* 1.14 *m at* 1 *m distance from the lamp.*

An embodiment of a reflector lamp according to the invention designed for use as an infrared radiator for therapeutic or stock breeding purposes has a largest diameter of 80 mm and consumes a power of 100 W, but nevertheless yields an irradiance in the center of an irradiated field which is equal to the irradiance which is achieved with a conventional infrared lamp of 95 mm diameter and a power of 150 W. In addition, the evenness of the irradiance is great. With a reflector lamp, according to the invention, of 95 mm diameter and 150 W, an irradiance is achieved in the center of the irradiated field which is 50% higher than that achieved with the conventional therapeutic lamp.

Several light sources must be used side by side for the irradiation of a surface area which is larger than the field which can be satisfactorily irradiated by one light source. A disadvantage of conventional lamps is that the drop in illuminance from the center of the illuminated field towards the periphery thereof, as a result of the Gaussian distribution of the luminous flux in the beam, leads to a high degree of unevenness of the illuminance of the surface illuminated by several lamps.

FIG. 1A shows the relative illuminance $E_{rel}$ of a base surface when irradiated by two conventional reflector lamps D from Table 1. The distance e to the center between the two lamps along the base surface is plotted on the abscissa, the height h of the lamp above the base surface being used as a unit of length. The illuminance in the center of a field illuminated by lamp L from Table 1 is taken as 100%.

It is apparent from FIG. 1A that $E_{rel}$ is higher when the lamps D have an interspacing which is equal to their height measured from the base surface (−0.5; +0.5) than when their interspacing is 1.2× this height (−0.6; +0.6). The average level is low also in the former case. The Figure also shows that $E_{rel}$ of the base surface is very uneven and that this unevenness is even greater in the case of an interspacing of the lamps D of 1.2 h.

FIG. 1B shows the same quantities when lamps L from Table 1 are used. In this Figure, $E_{rel}$ is shown for an interspacing 1.0 h (−0.5; +0.5) and for an interspacing 1.2 h (−0.6; +0.6). Obviously, $E_{rel}$ is higher in the former case also in this Figure. There is also an unevenness then, though smaller than in both situations shown in FIG. 1A. It is remarkable, however, that there is a substantially perfect evenness of the illuminance at an interspacing of 1.2 h. This illuminance, moreover, is much higher than either of the levels in FIG. 1A. It is emphasized that this high level and this great evenness are achieved at a greater interspacing 1.2 h than can be achieved with the smaller interspacing 1.0 h with lamps D.

A surface of a given size, accordingly, can be irradiated with a higher intensity and with a much greater uniformity with fewer lamps according to the invention than is possible with conventional lamps.

These properties are the result of the luminous intensity distribution in the beam from the electric lamp arrangement in a favorable embodiment thereof. In this embodiment, the center of curvature of the first mirroring wall portion is situated in a region having the shape of an ellipse R′ which is uniform to and lies within the ellipse R and which has a point situated at 0.3 1 d from the plane P at the other side of the axis of symmetry at a distance of 0.02 d removed therefrom as the point of intersection of its axes.

In FIG. 2A, the luminous flux I in a light beam of the lamp D is plotted as a function of the angle to the centerline of the beam (angle=0°). The luminous flux in the center of lamp D is taken as 100% for this. It is apparent from FIG. 2A that $I_{rel}$ for lamp D becomes lower in proportion as the angle becomes greater. Furthermore, it is shown that lamp L has a much higher luminous flux in the center of the beam, but also that the luminous flux increases up to an angle of approximately 20°, after which it drops away fairly steeply, in contrast to lamp D.

FIG. 2B shows the illuminance distribution of the fields illuminated by the two lamps, D and L, with the value in the center of the field of lamp D taken as 100%. The distance to this center is plotted on the abscissa, with the height of the lamp measured from the irradiated surface as the unit of length. The Figure shows that the illuminance effected by lamp L is higher to much higher than that effected by lamp D up to a large distance away from the center. It is also apparent that, in contrast to lamp L, the illuminance effected by lamp D decreases immediately starting from the center. The decrease continues up to a very large distance away from the center. The curve has a gentle, asymmetrical shape. The curve of lamp L by contrast has a steep and practically symmetrical shape. The curve has the shape of a mirrored S. The surface of the graph below the curve L is practically congruent to the surface above the curve. This means that, when a lamp $L_2$ is positioned which gives an illuminated field with its center at e/h=1.2, the total light intensity distribution is represented by a substantially straight line along the upper edge of the graph, cf. the drawn line in FIG. 1B.

In a favorable embodiment, therefore, the inventive lamp arrangement according to the invention provides an S-shaped illuminance distribution.

When a single electric lamp arrangement in accordance with the invention is used for illuminating a field, while it is in addition desirable for this field to be irradiated with a high degree of evenness, it is favorable when the first mirroring wall portion has a first section remote from the plane P curved substantially according to a circular arc whose center of curvature is situated in a region having the shape of an ellipse S whose major axis has a first end at the first side of the axis of symmetry at a distance of 1.20 d from the plane P and 0.03 d from the axis of symmetry, and a second end at the other side of the axis of symmetry at a distance of 0.50 d from the plane P and 0.12 d from the axis of symmetry, the major axis of this ellipse being 33.3 times the length of the minor axis, and a second section near the plane P curved substantially according to a circular arc whose center of curvature is situated in a region one side of the axis and which has the shape of an ellipse T whose major axis has a first end at a distance of 0.32 d from the plane P and 0.10 d from the axis of symmetry and a second end at a distance of 0.49 d from the plane P and 0.33 d from the axis of symmetry, the major axis of this ellipse being 11.3 times the length of the minor axis. In this case the light beam has a higher luminous flux at acute angles to the axis than along the axis. The luminous flux is substantially proportional to $\cos\alpha^{-3}$ at an angle $\alpha$ to the axis of symmetry up to comparatively great angles, particularly when the centers of curvature of the first mirroring wall portion lie in a region having the shape of an ellipse S′ uniform to and situated within the ellipse S with a point of intersection of its axes situated at 0.3 d away from the plane P and at 0.02 d from the axis of symmetry, at the other side thereof, and in a region having the shape of an ellipse T′ uniform to and situated within the ellipse T with a point of intersection of its axes situated at 0.41 d away from the plane P and at 0.2 d from the axis of symmetry at the other side thereof, and when the second mirroring wall portion has a center of curvature situated in a region having the shape of an ellipse Q′ uniform to and situated within the ellipse Q with a point of intersection of its axes situated at 0.03 d away from the plane P and at 0.06 d from the axis of symmetry.

FIG. 3A shows that the luminous intensity in the beam of the reflector lamp L′ according to the invention increases very markedly up to an angle of 30° to the axis, upon which it drops sharply. The luminous flux has its half value ($\frac{1}{2}I_0$) at approximately 38°. The beam accordingly has a width of approximately 76°.

A flat illuminated field has a greater distance to the light source at a distance away from the center than in the center. A standard light cone directed with its base at the center of the field as a result illuminates a smaller surface area than an equally large light cone directed laterally of the center. To achieve an equally large illuminance in the center and laterally of the center, a standard light cone must have a smaller luminous flux directed at the center than a standard cone directed laterally of the center.

FIG. 3B shows that the illuminance is constant up to e/h=approximately 0.57 (=tg30° ). The illuminance drops sharply at a greater distance away from the center. The illuminated field has a sharp boundary.

If not only the distribution of the incident radiation over an irradiated field is of importance, but also the luminance of this field, the invention lamp arrangement is capable of providing a beam in which the difference between $I_\alpha$ and $I_0$ is even greater. An observer of the field positioned near the light source normally receives more light into his eye from the center of the field than from regions next to the center. This is the result of the fact that light is reflected in mirror fashion towards the observer only from the center. If the luminance of the field laterally of the center is to be equally large as in the center, the illuminance laterally of the center must accordingly be greater than in the center.

Facets may be superimposed on a mirroring wall portion, for example, on the first, on the second, or on both portions.

It is clear that the transition between the first and the second wall portion is rounded in the case of reflector lamps having, for example, blown lamp vessels whose portions are mirror-coated. Sharp transitions cannot be manufactured or lead to a lamp vessel having an insufficient mechanical strength.

BRIEF DESCRIPTION OF THE DRAWINGS

This and other aspects of the electric lamp arrangement according to the invention are shown in the drawing figures, in which.

DESCRIPTION OF THE PREFERRED EMBODIMENTS

Figure 1A:
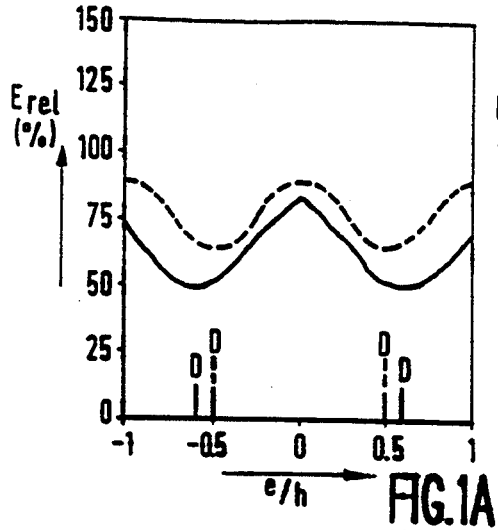
FIG.1A (PRIOR ART)
FIG. 1A shows the distribution of the illuminance over a surface irradiated by two conventional reflector lamps D.
Figure 1B:
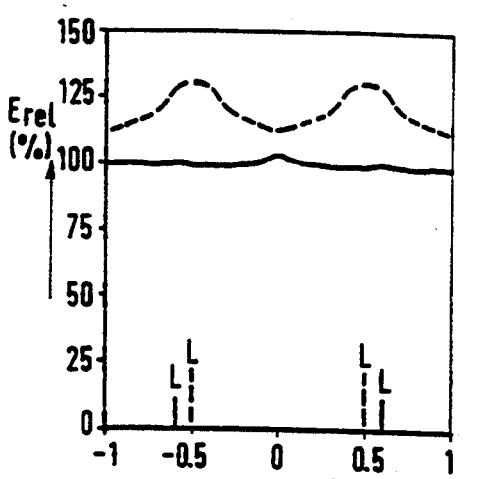
FIG. 1B shows the same for two reflector lamps L according to the invention.
Figure 2A:
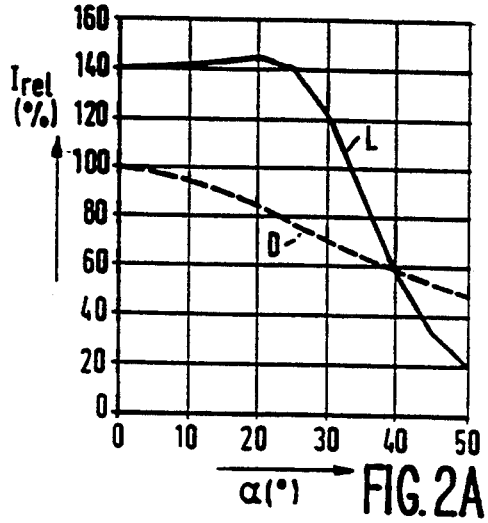
FIG. 2A shows the luminous intensity distribution in a light beam for lamp D and lamp L.
Figure 2B:
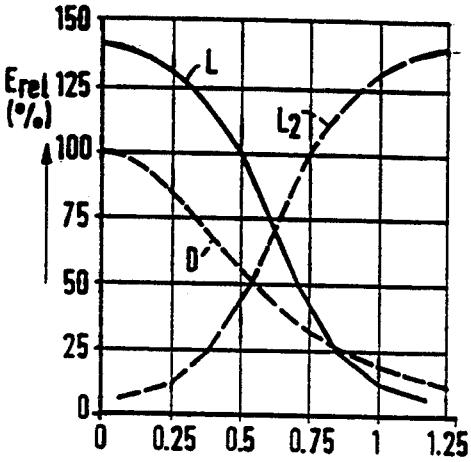
FIG. 2B shows the illuminance distribution over a field illuminated by lamp D and by lamp L.
Figure 3A:
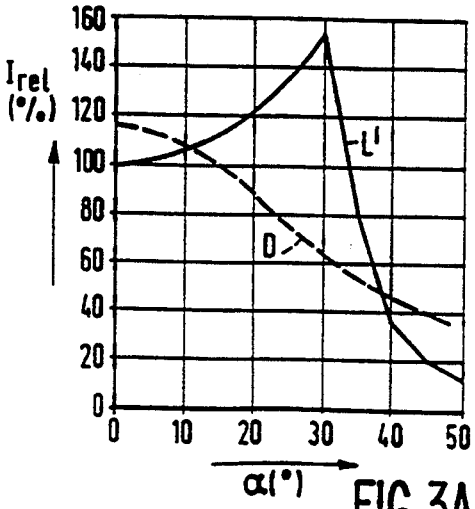
FIG. 3A shows the luminous intensity distribution in a beam of lamp L' according to the invention as compared with lamp D.
Figure 3B:
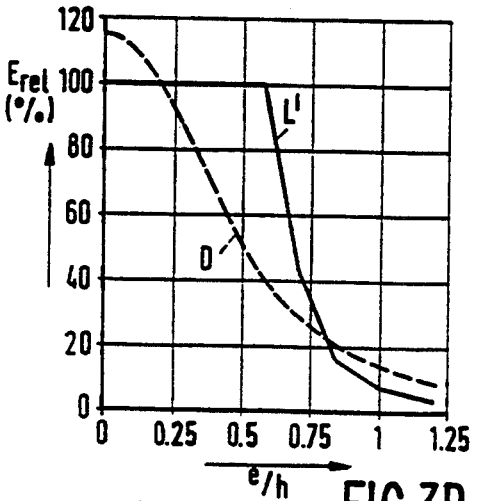
FIG. 3B shows the illuminance distribution over a surface illuminated by lamp L' and lamp D.
Figure 4:
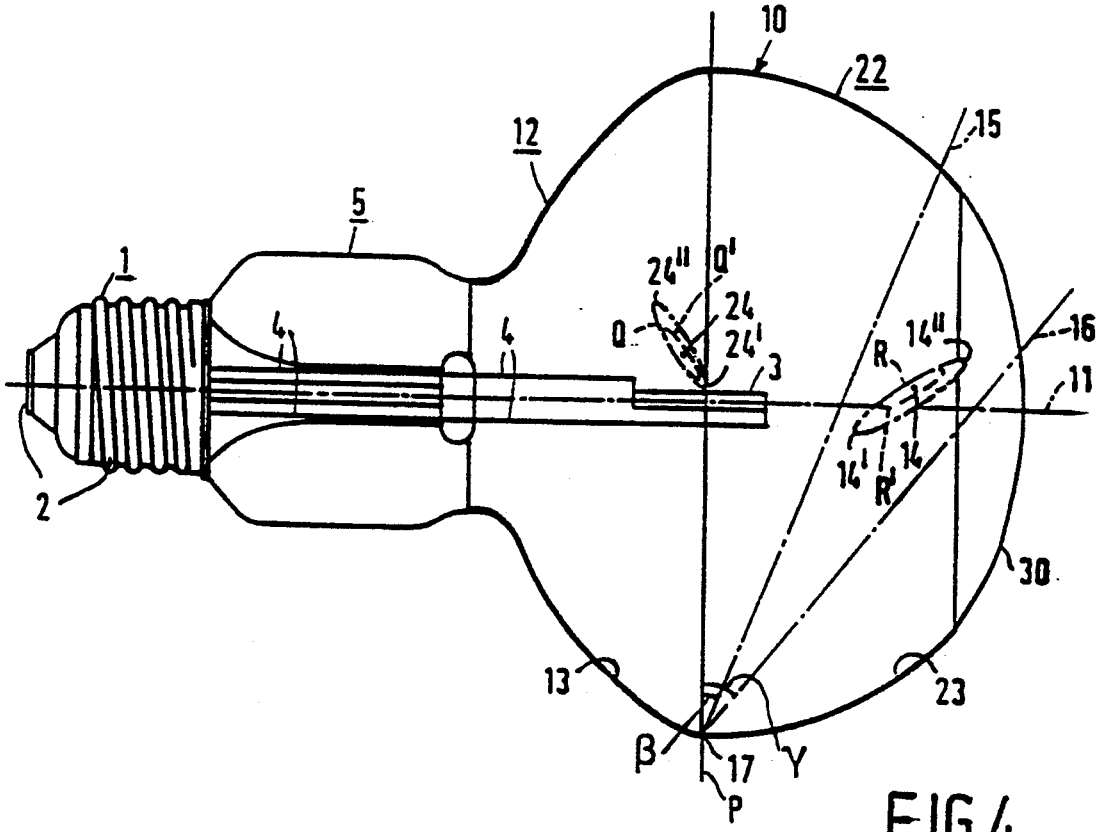
FIG. 4 shows a first embodiment of the electric light source with reflector according to the invention,in axial cross-section.

In FIG. 4, the electric lamp arrangement with reflector has a lamp cap 1 provided with contacts 2 and a rotationally symmetrical reflector 10 having an axis of symmetry 11 and a largest diameter d in a plane P transverse to the axis of symmetry. The reflector has a first, internally concave mirroring wall portion 12 behind the plane P which in axial cross-sections at a first side of the axis 11 is curved substantially according to a circular arc 13 with a center of curvature 14 in front of the plane P, which first wall portion is situated near the lamp cap 1. The reflector 10 also has a second, internally concave mirroring wall portion 22 in front of the plane P which in axial cross-sections at the first side of the axis 11 is curved substantially according to a circular arc 23 with a center of curvature 24 behind the plane P at the other side of the axis.

A light-transmissive window 30 of the reflector 10 is intersected by the axis 11. A light source 3 is arranged in the reflector 10 in the vicinity of the axis 11 and of the plane P and connected to current conductors 4 which extend to the contacts 2 of the lamp cap 1.

In the Figure, the first mirroring wall portion 12 in every axial cross-section at the first side of the axis 11 is curved substantially according to a circular arc having its center of curvature 14 situated in a region which lies predominantly at the other side of the axis and which is bounded by lines 15, 16 which enclose angles $\beta$ and $\gamma$ of 23° and 39°, respectively, with the plane P and which intersect the plane P in the point 17 where the first mirroring wall portion 12 intersects the plane P at the first side of the axis.

The second mirroring wall portion 22 has a center of curvature 24 situated in a region having the shape of an ellipse Q whose major axis has a first end 24' in the plane P at a distance of 0.02 d from the axis of symmetry 11, and a second end 24" at a distance of 0.07 d from the plane P and 0.13 d from the axis of symmetry, the major axis of this ellipse having 6.8 times the length of the minor axis. The light-transmissive window 30 has a largest diameter smaller than 0.7 d.

FIG. 4 shows a reflector lamp provided with a, for example, blown glass lamp vessel 5 which is closed in a vacuumtight manner and which is integral with the reflector 10 and the window 30. The mirroring wall portions have a coating of, for example, aluminum. The light source 3 is a coiled incandescent body which is axially and linearly arranged around the axis 11 and through the plane P.

The first mirroring wall portion 12 in the Figure has a center of curvature 14 situated in a region having the shape of an ellipse R whose major axis has a first end 14' at the first side of the axis of symmetry 11 at a distance of 0.23 d from the plane P and 0.04 d from the axis of symmetry, and a second end 14" at the other side of the axis of symmetry, at a distance of 0.38 d from the plane P and 0.07 d from the axis of symmetry. The major axis of the ellipse R is 10.4 times the length of the minor axis. The luminous window 30 has a largest diameter of approximately 0.65 d.

The center of curvature 14, which in FIG. 4 lies at 0.31 d from the plane P and at 0.02 d from the axis 11, also lies in the region having the shape of an ellipse R' which is uniform to and lies within the ellipse R and which has a point situated at 0.31 d from the plane P as the point of intersection of its axes, which point lies at the other side of the axis of symmetry at 0.02 d away therefrom. The reflector lamp gives a wide beam of light of approximately 60° which gives an S-shaped illuminance on an irradiated surface. The center of curvature 24 lies at 0.03 d from the plane P and at 0.06 from the axis 11.

The light-transmissive window may be colored, for example, red in the case of heat radiator lamps.

Figure 5:
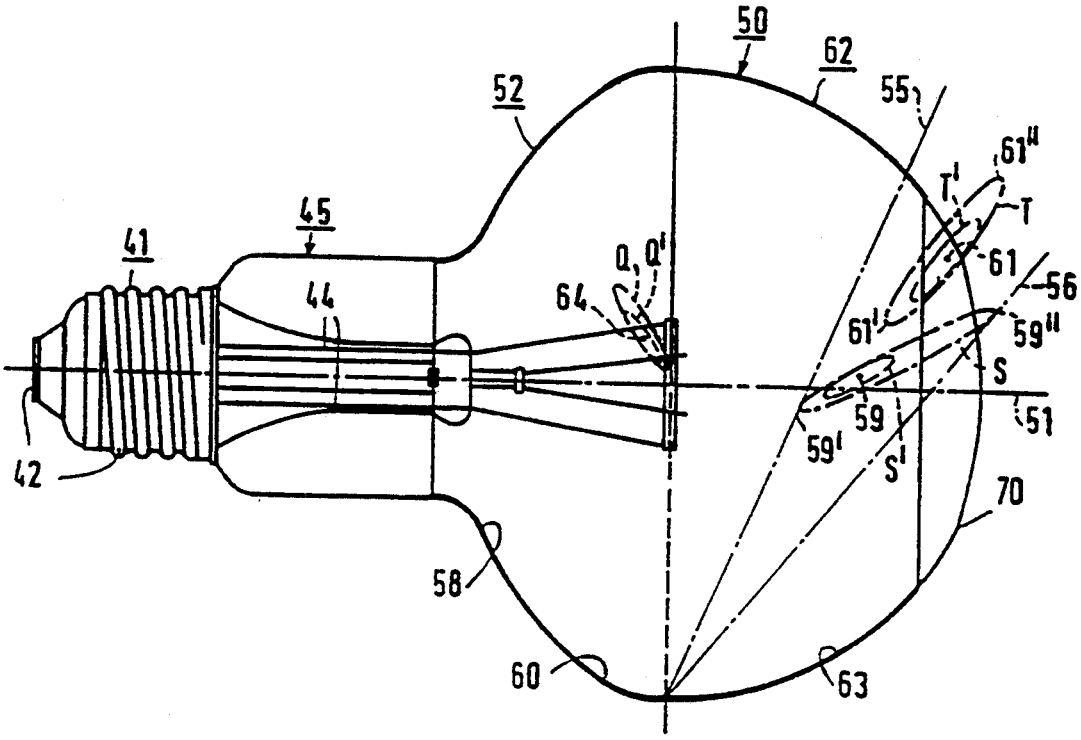
FIG. 5 shows a second embodiment in axial cross-section.

In the following Figures, parts corresponding to parts from the preceding Figure have reference numerals which are 40 higher each time. In FIG. 5, the first mirroring wall portion 52 has a first section 58 remote from the plane P and curved substantially according to a circular arc whose center of curvature 59 is situated in a region having the shape of an ellipse S whose major axis has a first end 59' at the first side of the axis of symmetry 51 at a distance of 0.20 d from the plane P and 0.03 d from the axis of symmetry, and a second end 59'' at the other side of the axis of symmetry at a distance of 0.50 d from the plane P and 0.12 d from the axis of symmetry. The major axis of this ellipse is 33.3 times the length of the minor axis. A second section 60 adjacent the plane P and curved substantially according to a circular arc has its center of curvature 61 in a region at the other side of the axis 51 with the shape of an ellipse T whose major axis has a first end 61' at a distance of 0.32 d from the plane P and 0.10 d from the axis of symmetry, and a second end 61' at a distance of 0.49 d from the plane P and 0.33 d from the axis of symmetry. The major axis of this ellipse is 11.3 times the length of the minor axis.

The largest diameter of the light-transmissive window is approximately 0.63 d. The location of the ellipse Q and of the center of curvature 64 within the ellipse Q' are as in FIG. 4.

The reflector lamp shown gives a beam of light which illuminates a field within a cone having an apex angle of approximately 60° with substantially the same intensity everywhere.

Figure 6:
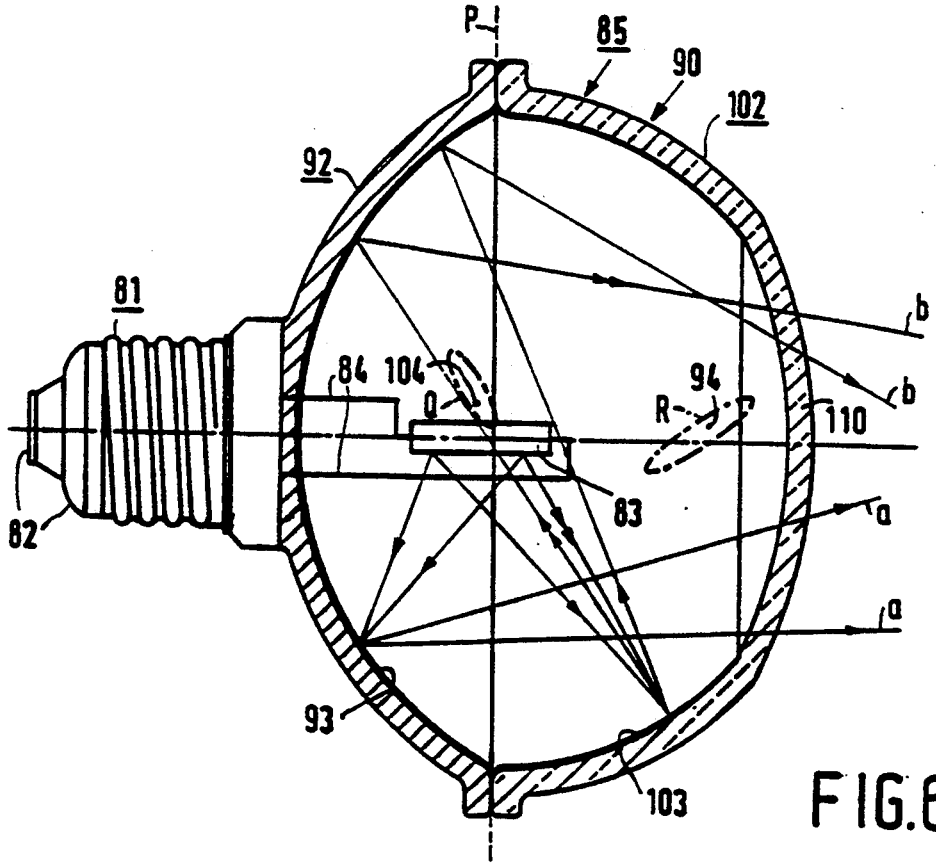
FIG. 6 shows a third embodiment in axial cross-section.

The light source 83 of FIG. 6 is an envelope inside which an electric discharge can be generated between electrodes in a filling of sodium, mercury, and rare gas. The reflector 90 is integral with a lamp vessel 85 made of molded glass. The lamp vessel consists of a first part, which comprises the first mirroring wall portion 92, and a second part, which comprises the second mirroring wall portion 102 and the window 110. Both parts are interconnected so as to form a seam which lies in the plane P. The light-transmissive window 110 has a largest diameter of approximately 0.68 d. The ellipses Q and R are situated as in FIG. 4, as are the points 94 and 104. The light rays a are thrown to the exterior through the first wall portion 92. The light-rays b first hit the second wall portion 102, from where they are reflected to the first portion, after which they leave the lamp vessel 85. In the beam formed, they join the rays which issue to the exterior without being reflected. The lamp vessel 85 supports the lamp cap 81.

Figure 7:
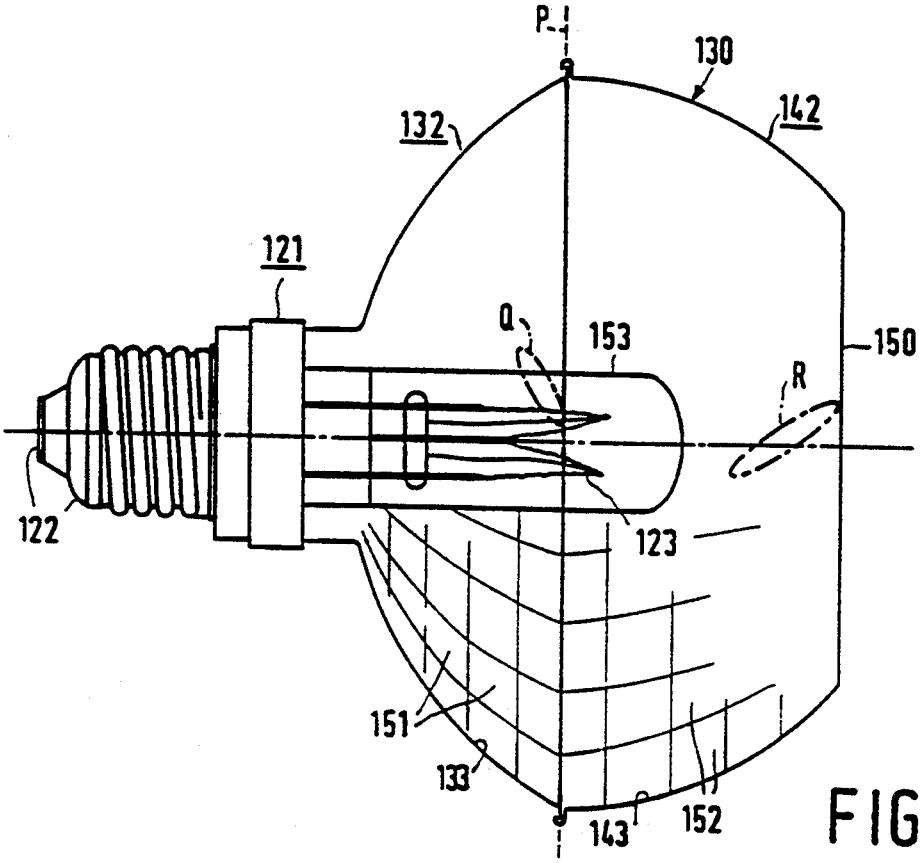
FIG. 7 shows a fourth embodiment in axial cross-section.

In the lamp/reflector unit of FIG. 7, the light source 123, an M-shaped, axially arranged incandescent body in an inert gas comprising a halogen, has a hard-glass envelope 153 closed in a vacuumtight manner and fixed in a metal reflector 130. The reflector 130 supports the lamp cap 121 and has a riveted seam in the plane P. The centers of curvature and the ellipses Q and R are situated as in the preceding Figure. Both wall portions 132 and 142 have superimposed facets 151 and 152, respectively, of which a number are shown. The window 150 has a diameter of approximately 068 d.

Figure 8:
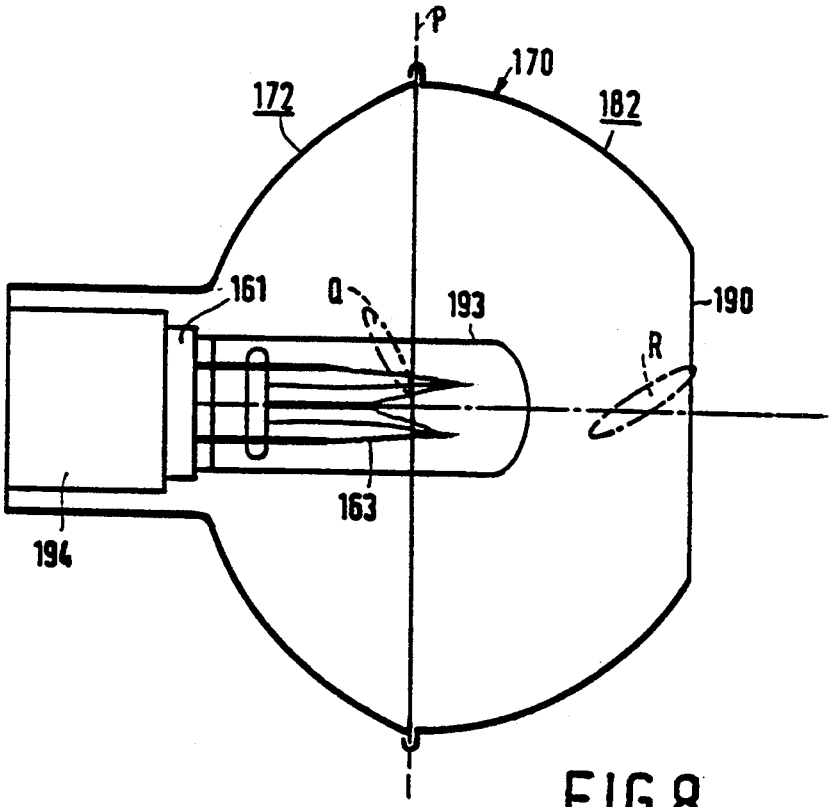
FIG. 8 shows an embodiment of the reflector in axial cross-section.
Figure 9:
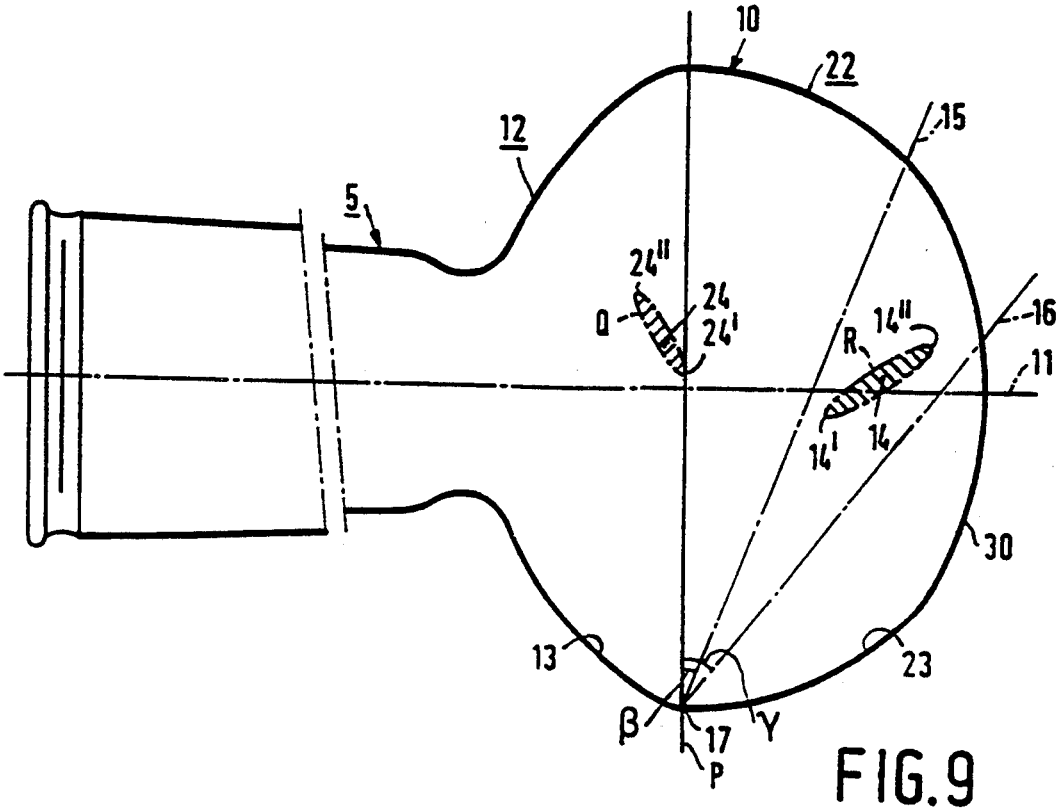
FIG. 9 shows the blown bulb used in the embodiment of FIG. 4 in lateral elevation.

In FIG. 8, the reflector 170 is separable in the plane P, which renders easier the insertion of an electric lamp with a lamp cap 161 and a light source 163 accommodated in an envelope 193. The reflector has a lampholder 194 near the first mirroring wall portion 172. The window 190 is approximately 068 d.

I claim:

1. An electric lamp arrangement comprising:

a. a lamp cap (1) provided with contacts (2);

b. a rotationally symmetrical reflector (10) having an axis of symmetry (11) and a largest diameter (d) in a plane (P) transverse to the axis of symmetry, said reflector including:

(1) a first internally concave, mirroring wall portion (12) behind the plane (P) which in axial cross-sections at a first side of the axis (11) is curved substantially according to a circular arc (13) having a center of curvature (14) in front of the plane (P), which first wall portion is situated adjacent the lamp cap (1); and (2) a second internally concave, mirroring wall portion (22) in front of the plane (P) which in axial cross-sections at the first side of the axis (11) is substantially curved according to a circular arc (23) having a center of curvature (24) behind the plane (P), at the other side of the axis;

c. a light-transmissive window (30) which is intersected by the axis (11); and d. an electric light source (3) arranged in the reflector (10) in the vicinity of the axis (11) and of the plane (P) and connected to current conductors (4) which extend to the contacts (2) of the lamp cap (1), characterized in that:

the first mirroring wall portion (12) in every axial cross-section at the first side of the axis (11) is curved substantially according to a circular arc having its center of curvature (14) situated in a region which lies predominately at the other side of the axis and which is bounded by lines (15, 16) which enclose an angle $\beta$ and an angle $\gamma$ of 23° and 39°, respectively, with the plane (P) and which intersect the plane (P) in the point (17) where the first mirroring wall portion (12) intersects the plane (P) at the first side of the axis;

the second mirroring wall portion (22) has a center of curvature (24) which is situated in a region having the shape of an ellipse (Q) whose major axis has a first end (24') in the plane (P) at a distance of 0.02 d from the axis of symmetry (11) and a second end (24'') at a distance of 0.07 d from the plane (P) and 0.13 d from the axis of symmetry, which ellipse has a major axis which is 6.8 times the length of the ellipse minor axis; and the light-transmissive window (30) has a largest diameter smaller than 0.8 d.

2. An electric lamp arrangement as claimed in claim 1, characterized in that the first mirroring wall portion (12) has a center, of curvature (14) which is situated in a region having the shape of an ellipse (R) whose major axis has a first end (14') at the first side of the axis of symmetry (11) at a distance of 0.23 d from the plane (P) and 0.04 d from the axis of symmetry, and a second end (14'') at the other side of the axis of symmetry at a distance of 0.38 d from the plane (P) and 0.07 d from the axis of symmetry, which ellipse has a major axis which is 10.4 times the length of the ellipse minor axis.

3. An electric lamp arrangement as claimed in claim 2, characterized in that the first mirroring wall portion (12) is curved to a circular arc (13) whose center of curvature (14) is situated in a region having the shape of an ellipse (R') which is uniform to and lies within the ellipse (R) and which has a point (14) situated at 0.31 d from the plane (P) at the other side of the axis of symmetry at a distance 0.02 d removed therefrom as the point of intersection of its axes.

4. An electric lamp arrangement as claimed in claim 1, characterized in that the first mirroring wall portion (52) has a first section (58) curved substantially according to a circular arc and remote from the plane (P), whose center of curvature (59) is situated in a region having the shape of an ellipse (S) whose major axis has a first end (59') at the first side of the axis of symmetry (51) at a distance of 0.20 d from the plane (P) and 0.03 d from the axis of symmetry and a second end (59'') at the other side of the axis of symmetry at a distance of 0.50 d from the plane (P) and 0.12 d from the axis of symmetry, the major axis of this ellipse being 33.3 times the length of the ellipse minor axis, and a second section (60) curved substantially according to a circular arc near the plane (P) whose center of curvature (61) is situated in a region at the other side of the axis (51) and which has the shape of an ellipse T whose major axis has a first end (61'') at a distance of 0.32 d from the plane and 0.10 d from the axis of symmetry and a second end (61'') at a distance of 0.49 d from the plane (P) and 0.33 d from the axis of symmetry, the major axis of this ellipse being 11.3 times the length of the minor axis.

5. An electric lamp arrangement as claimed in claim 4, characterized in that the first mirroring wall portion (52) is curved according to circular arcs (58, 60) whose centers of curvature (59, 61) lie in a region having the shape of an ellipse (S') uniform to and situated within the ellipse S with a point of intersection (59) of its axes situated at 0.3 d away from the plane (P) and at 0.02 d from the axis of symmetry, at the other side thereof, and in a region having the shape of an ellipse (T') uniform to and situated within the ellipse (T) with a point of intersection of its axes situated at 0.41 d away from the plane (P) and at 0.2 d from the axis of symmetry at the other side thereof, respectively, and in that the second mirroring wall portion (62) is curved according to a circular arc (63) having a center of curvature (64) situated in a region having the shape of an ellipse (Q') uniform to and situated within the ellipse (Q) with a point of intersection (64) of its axes situated at 0.03 d away from the plane (P) and at 0.06 d from the axis of symmetry.

6. An electric lamp arrangement as claimed in claim 1, 2 or 4, characterized in that facets (151) are superimposed on the first mirroring wall portion (132).

7. An electric lamp arrangement as claimed in claim 6, characterized in that facets (152) are superimposed on the second mirroring wall portion (142).

8. An electric lamp arrangement as claimed in claim 1, 2 or 4, characterized in that the light source (3) is accommodated in a lamp vessel (5) with which the reflector (10) is integral and which supports the lamp cap (1).

9. An electric lamp arrangement as claimed in claim 8, characterized in that the lamp vessel (5) is a blown glass bulb which is sealed in a vacuumtight manner.

10. An electric lamp arrangement as claimed in claim 8, characterized in that the lamp vessel (85) has a seam in the plane (P).

11. An electric lamp arrangement as claimed in claim 1, 2 or 4, characterized in that the light source (123) has an envelope (153) which is sealed in a vacuumtight manner, which light source is connected to the reflector (130) so as to form a lamp/reflector unit which supports a lamp cap (121).

12. A reflector provided with a lampholder suitable for use in the electric light source with reflector as claimed in claim 1.

13. A reflector as claimed in claim 12, characterized in that the reflector (170) is separable in the plane (P).

14. A blown glass bulb having any of the shape characteristics of the reflector as defined in claim 1.

* * * * *